US012691350B1

(12) United States Patent
Shi

(10) Patent No.: US 12,691,350 B1
(45) Date of Patent: Jul. 28, 2026

(54) INTEGRATED GOLF BALL TRAY

(71) Applicant: SHENZHEN YISHIFU E-COMMERCE CO., LTD, Shenzhen (CN)

(72) Inventor: Qing Shi, Shenzhen (CN)

(73) Assignee: SHENZHEN YISHIFU E-COMMERCE CO., LTD, Shenzhen (CN)

( * ) Notice: Subject to any disclaimer, the term of this patent is extended or adjusted under 35 U.S.C. 154(b) by 0 days.

(21) Appl. No.: 19/383,783

(22) Filed: Nov. 10, 2025

(30) Foreign Application Priority Data

Aug. 26, 2025 (CN) ..... 202521823288.2

(51) Int. Cl.
*A63B 69/36* (2006.01)

(52) U.S. Cl.
CPC ..... *A63B 69/3661* (2013.01)

(58) Field of Classification Search
CPC ..... A63B 69/3661
USPC ..... 473/150, 168, 218, 266, 270, 278, 279
See application file for complete search history.

(56) References Cited

U.S. PATENT DOCUMENTS 3,586,335 A * 6/1971 D'Antonio, Sr. .. A63B 69/3623 473/278
3,599,982 A * 8/1971 Elesh ..... A63B 69/3661 473/278
4,146,231 A * 3/1979 Merkle ..... A63B 69/3667 473/269
4,844,470 A * 7/1989 Hammon ..... A63B 69/3661 473/278
5,004,243 A * 4/1991 Dlouhy ..... A63B 69/3661 473/279
5,011,152 A * 4/1991 Hugunin ..... A63B 69/3694 454/289
5,692,967 A * 12/1997 Guyer ..... A63B 69/3661 473/262
6,120,383 A * 9/2000 Brown ..... A63B 57/0006 473/135
6,746,340 B1 * 6/2004 Dover ..... A63B 69/3661 473/278
6,773,356 B2 * 8/2004 Odom ..... A63B 69/3623 473/150
6,913,544 B2 * 7/2005 Tiffin ..... A63B 69/3661 473/278
7,384,346 B2 * 6/2008 McFarlin ..... A63B 69/3661 473/278
9,486,689 B2 * 11/2016 Hooper ..... A63B 57/20
10,639,538 B2 * 5/2020 Hooper ..... A63B 69/3621
11,325,015 B1 * 5/2022 Modawell ..... A63B 26/003
2006/0135280 A1 * 6/2006 Kim ..... A63B 69/3661 473/278
2008/0070713 A1 * 3/2008 Scarbrow ..... A63B 69/3661 473/278
2012/0178546 A1 * 7/2012 Park ..... A63B 69/3673 473/278
2023/0020996 A1 * 1/2023 Jones ..... A63B 69/3676
2023/0383478 A1 * 11/2023 Ross ..... E01C 13/08

* cited by examiner

*Primary Examiner* — Joseph B Baldori

(57) ABSTRACT

An integrated golf ball tray includes: a mat (1); a surface layer (2), disposed at a top of the mat (1); a ball tray assembly (3), disposed at an end of the mat (1); and a plurality of insertion holes (4), defined in a top surface of the surface layer (2) at an end near the ball tray assembly (3).

20 Claims, 4 Drawing Sheets

INTEGRATED GOLF BALL TRAY

CROSS REFERENCE TO RELATED APPLICATIONS

The present application claims the priority of the Chinese patent application No. 2025218232882, filed on Aug. 26, 2025, contents of which are incorporated herein by its entireties.

TECHNICAL FIELD

Embodiments of the present disclosure relate to the technical field of golf training equipment, and more specifically, to an integrated golf ball tray.

BACKGROUND

A golf swing practice mat serves as an indispensable essential equipment in golf training. The golf swing practice mat is critical for assisting a player to refine a swing technique and to stabilize a swing motion. For golf enthusiasts, including both beginners practicing fundamental performance and professional players consolidating skills daily, the practice mat is needed for repetitive training.

In a traditional golf training situation, the practice mat and a ball tray on which golf balls are placed may be typically separated from each other. The separation may have various drawbacks. During training, the player must carry the practice mat and the ball tray independently from each other, increasing burden of transportation. When the practice mat and the ball tray are in use, the player may spend time on adjusting a relative position between the ball tray and the practice mat to enable subsequent ball retrieval to be performed easily, and therefore, a training efficiency may be affected.

Accordingly, an integrated golf ball tray is provided.

SUMMARY

In the present section, certain aspects of embodiments of the present disclosure are summarized, and some embodiments are briefly introduced. Simplifications or omissions may be made in the present section, in the abstract and in the title of the present disclosure, so as to avoid obscuring purposes of the present section, the abstract, and the title. The simplifications or omissions shall not be used to limit the scope of the present disclosure.

As described in the above, when the practice mat and the ball tray are separated from each other, inconvenience of transportation may be caused, and the relative position therebetween when being in use may need to be adjusted. Therefore, the present disclosure provides an integrated golf ball tray to solve the technical problem raised in the above.

The present disclosure provides an integrated golf ball tray, including: a mat; a surface layer, disposed at a top of the mat; a ball tray assembly, disposed at an end of the mat; a plurality of insertion holes, defined in a top surface of the surface layer at an end near the ball tray assembly.

In some embodiments, the ball tray assembly includes a placement plate and a shielding strip. The placement plate is disposed at an end of the mat, and the shielding strip is fixedly connected to an edge of a top of the placement plate.

In some embodiments, an drainage gap is formed between each of two ends of the shielding strip and the surface layer, a height of the surface layer is greater than a height of the shielding strip, and a height of the placement plate is the same as a height of the mat.

In some embodiments, a snap slot is defined in a side of the placement plate and a snap bar is fixedly connected to an end of the mat.

In some embodiments, the snap slot and the snap bar are mated to each other.

According to the present disclosure, following technical effects can be achieved.

In the present disclosure, the ball tray assembly and the practice mat are integrally formed as a one-piece structure. The practice mat and the ball tray in the art that need to be carried independently from each other now form one structure. A player may not need to store and transport two components separately, significantly reducing operational steps during transportation. Cumbersome carrying issues caused by the components in the art being separated from each other may be solved. Furthermore, since the ball tray assembly and the practice mat are integrally formed as the one-piece structure, it is ensured that the relative position between the ball tray and the practice mat is fixed, saving time spent on adjusting a spacing between the ball tray assembly and the practice mat when the ball tray assembly and the practice mat are being in use, and therefore, a training preparation efficiency may be improved.

Figure 1:
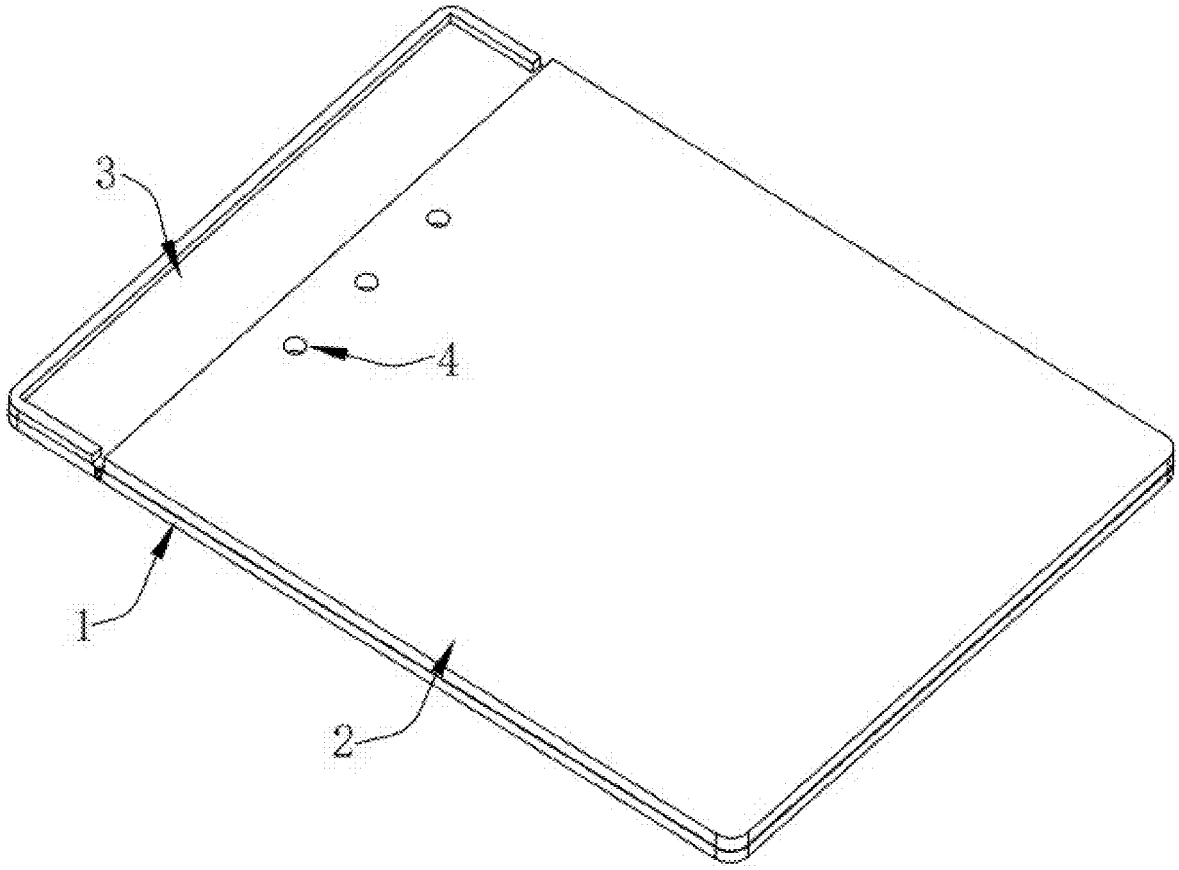
FIG. 1 is a structural schematic view of an integrated golf ball tray according to an embodiment of the present disclosure.

Reference numerals in the drawings: 1. mat; 2. surface layer; 3. ball tray assembly; 31. placement plate; 32. shielding strip; 4. insertion hole; 5. snap slot; 6. snap bar; 7. Drainage gap.

DETAILED DESCRIPTIONS

In order to enable objectives, features, and advantages of the present disclosure to be more understandable, implementations of the present disclosure will be described in detail below by referring to the accompanying drawings.

The following description includes various specific details to facilitate thorough understanding of the present disclosure. However, the present disclosure may be implemented in other ways differing from those described herein. Any ordinary skilled person in the art may perform similar extensions without departing from the spirit and scope of the present disclosure. Therefore, the present disclosure is not limited to the embodiments disclosed below.

The term "an embodiment" or "embodiment" refers to a specific feature, a structure, or a property may be included in at least one embodiment of the present disclosure. The phrase "in an embodiment" in various sections of the specification does not necessarily refer to one same embodiment, nor does it imply that embodiments are mutually exclusive or can be selected independently from other embodiments.

Embodiment 1

Figure 2:
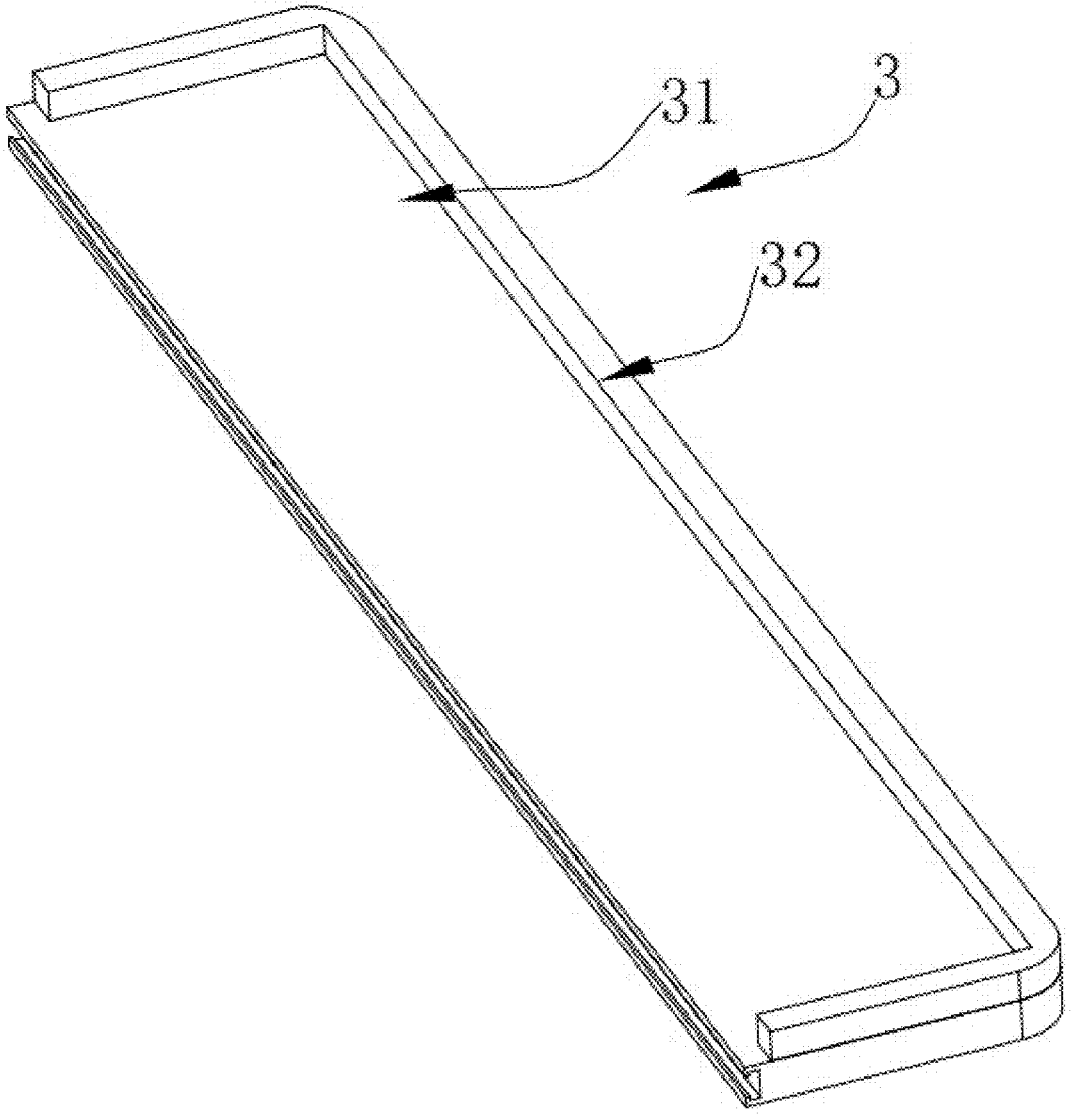
FIG. 2 is a structural schematic view of a ball tray assembly as shown in FIG. 1.
Figure 3:
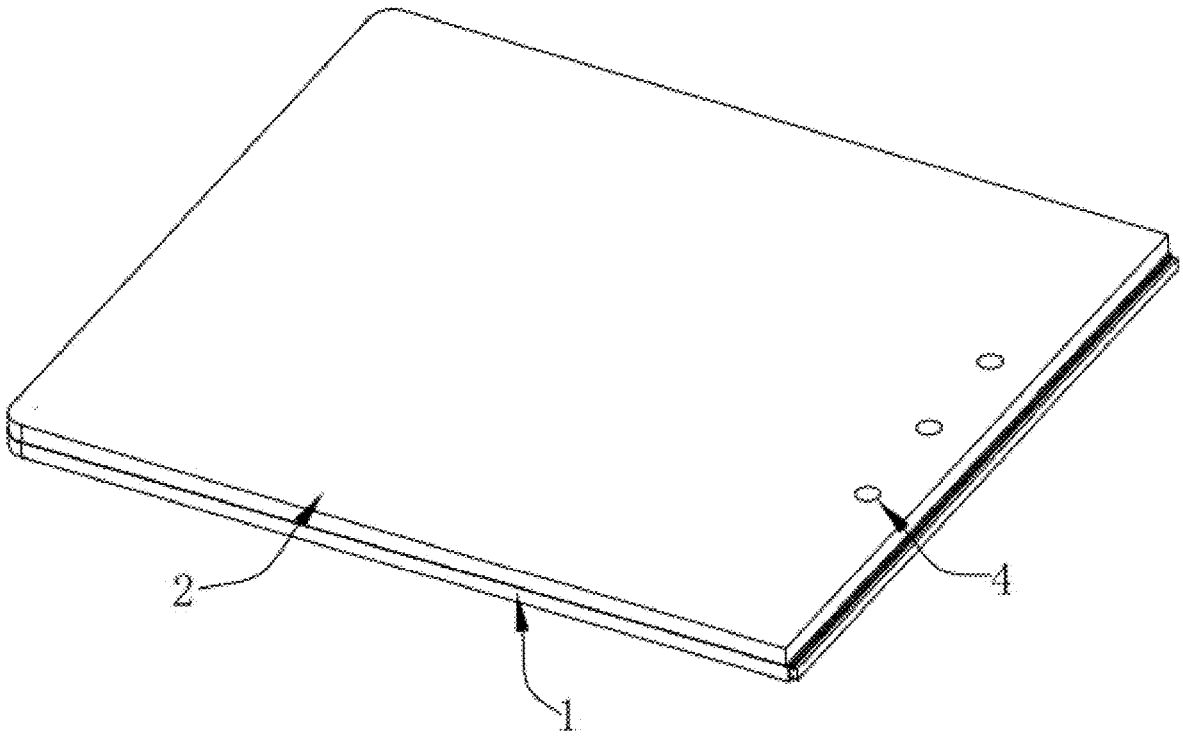
FIG. 3 is a structural schematic view of a mat and a surface layer as shown in FIG. 1.
Figure 4:
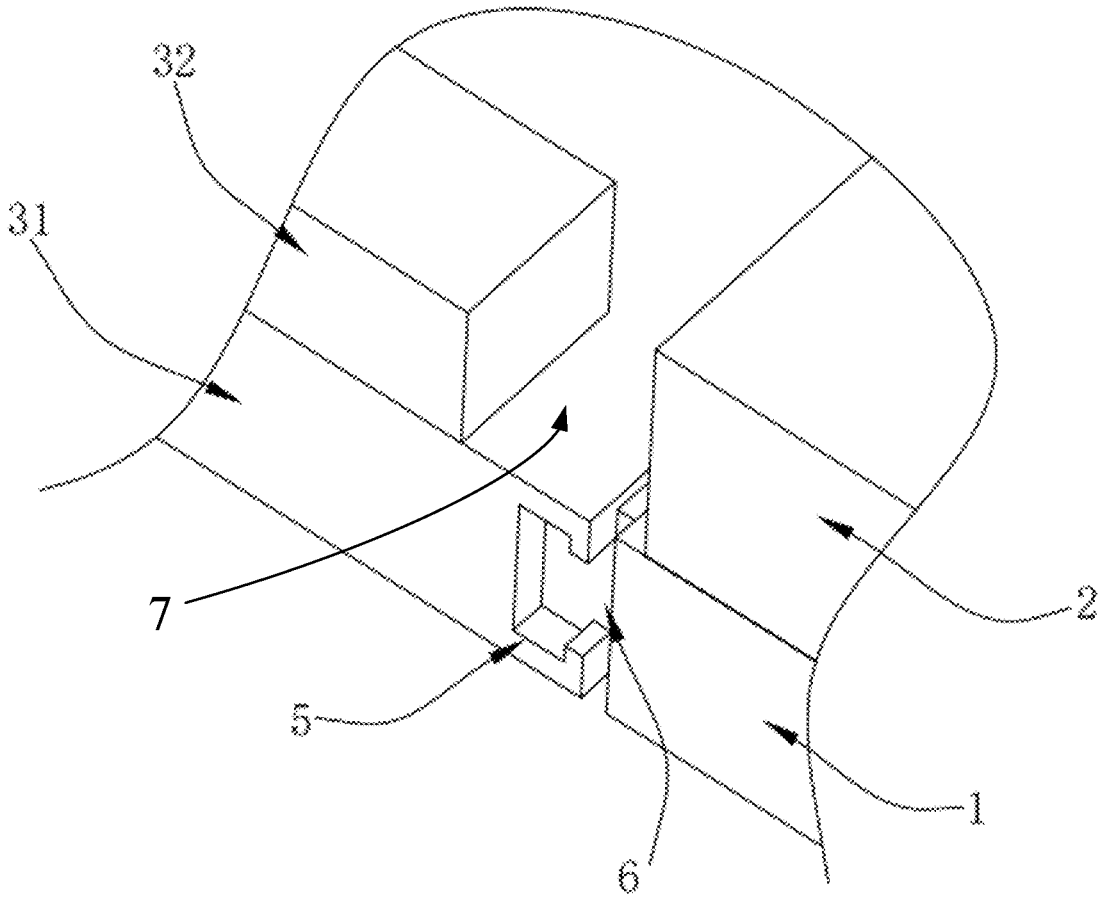
FIG. 4 is a partial structural schematic view of a snap slot and a snap bar as shown in FIG. 1.

As shown in FIGS. 1-3, a first embodiment of the present disclosure is provided.

The present embodiment provides an integrated golf ball tray including: a mat 1; a surface layer 2, disposed at a top of the mat 1; a ball tray assembly 3, disposed at an end of the mat 1; a plurality of insertion holes 4. Each of the plurality of insertion holes 4 is defined in a top surface of the surface layer 2 at an end near the ball tray assembly 3.

The surface layer 2 may be artificial turf made of PP and PE, having a density of approximately 71600 tuft stitches per square meter. The PP accounts for about 85% by weight, and the PE accounts for approximately 15% by weight. A height of the surface layer 2 may be 16 mm. After performing a high-temperature crimping process, crimped upright grass tufts may be formed. The above density and height may optimally avoid a golf ball club from directly contacting materials beneath the grass tufts, such that any damage to the mat may be prevented. The ratio of approximately 85% PP and 15% PE enables the grass tufts to maintain rigidity, due to rigidity of the PP, and to have toughness and flexibility, due to softness of the PE. Therefore, stretch resilience and comfort may be ensured when being in use.

For example, the ball tray assembly 3 includes a placement plate 31 and a shielding strip 32. The placement plate 31 is disposed at an end of the mat 1. The shielding strip 32 is fixedly connected to a top edge of the placement plate 31.

Furthermore, the placement plate 31 may be made of EVA having 25 Shore hardness, which is the same as the mat 1. In this way, durability, resistance to high/low temperatures, resistance to sunshine exposure, good resilience, tear resistance, and appropriate softness are provided. The placement plate 31 may have a smooth surface to reduce resistance against ball rolling. The shielding strip 32 and the placement plate 31 may be integrally molded as a one-piece structure. At least three rows of golf balls may be placed at the top of the placement plate 31, and an additional space may be left enabling the golf club to be used to retrieve any golf ball.

For example, a drainage gap 7 is formed between each of two ends of the shielding strip 32 and the surface layer 2. The height of the surface layer 2 is higher than a height of the shielding strip 32. A height of the placement plate 31 is the same as a height of the mat 1.

Furthermore, the drainage gap 7 has a width of 10 mm. In a case that, when the integrated golf ball tray is being in use outdoors under heavy rain, water may be accumulated in a ball tray area and cannot be drained away. Therefore, the drainage gap 7 is defined to facilitate the water to be drained away. The integrated golf ball tray may be lifted slightly, and water may be drained out.

When the integrated golf ball tray is being in use, the mat 1 may be placed flat on the ground. The ball tray assembly 3 may be assembled properly by engaging a snap bar 6 with a snap slot 5. A golf ball may be placed on the placement plate 31 and may be pushed to the surface layer 2 for a user to perform swinging practice. When assisted training is needed, a marker rod may be inserted into the insertion hole 4.

In summary, as the ball tray assembly 3 and the mat 1 are integrally formed as the one-piece structure, the practice mat and the ball tray, which may be carried independently from each other in the art, now form one structure. The player may not need to store and transport two components separately, significantly reducing operational steps during transportation. Cumbersome carrying issues caused by the components in the art being separated from each other may be solved. Furthermore, since the ball tray assembly and the practice mat are integrally formed as the one-piece structure, it is ensured that the relative position between the ball tray assembly and the practice mat is fixed, saving time spent on adjusting a spacing between the ball tray assembly and the practice mat when the ball tray assembly and the practice mat are being in use, and therefore, a training preparation efficiency may be improved Embodiment 2

As shown in 4, a second embodiment of the present disclosure is provided.

In an embodiment, the snap slot 5 is formed on a side of the placement plate 31, and the snap bar 6 is fixedly connected to an end of the mat 1.

Furthermore, the snap slot 5 is U-shaped. A surface of the snap bar 6 is arranged with protruding patterns to be mated with recesses on an inner wall of the snap slot 5. In this way, connection stability is improved.

For example, the snap slot 5 is mated to the snap bar 6.

Furthermore, the snap bar 6 has elasticity. After being inserted into the snap slot 5, the snap bar 6 may be slightly expanded, such that tight connection is achieved.

When being in use, the snap bar 6 is inserted into the snap slot 5 from one end of the snap slot 5, until two ends of the snap bar 6 to be aligned with the two end drainage gaps 7 of the snap slot 5. In this way, installation of the ball tray assembly 3 is completed.

In summary, snapping between the snap bar 6 and the snap slot 5 enables the ball tray assembly 3 to be quickly assembled and disassembled, such that stains on the placement plate may be cleared easily, or ball tray assemblies 3 in various specifications may be assembled to satisfy requirements for various training phases.

It may be important to note that structures and arrangements of the present disclosure shown in various exemplary embodiments are merely illustrative. Although only a few embodiments of the present disclosure are described in detail herein, any skilled artisan shall understand that various modifications may be possible without departing from the novelty and advantages described herein (such as variations in sizes, dimensions, structures, shapes, and proportions of various components; parameter values (such as temperatures, pressures, and so on), mounting arrangements, materials, colors, orientations, and so on). For example, a component shown as integrally formed may include a plurality of parts or elements; a position of a component may be inverted or altered; and the nature, the number, or locations of discrete components may be changed or modified. Therefore, all such modifications are intended to be included within the scope of the present disclosure. An order or a sequence of any process or method steps may be altered or rearranged according to alternative embodiments. In claims, any "apparatus with function" term is intended to cover structures described herein that perform the stated function, encompassing not only structural equivalents but also equivalent structures. Other substitutions, modifications, alterations, and omissions may be made in the design, operation, and arrangement of the exemplary embodiments without departing from the scope of the present disclosure. Therefore, the present disclosure is not limited to specific embodiments but extends to various modifications that remain within the scope of the appended claims.

Furthermore, in order to provide concise description of exemplary embodiments, not all features (i.e., those features that are unrelated to the preferred mode of implementing the present disclosure or those features that are unrelated to achieving the present disclosure) of actual embodiments may be described.

It should be understood that, during developing any actual implementation, a large amount of specific implementation decisions may be made in any engineering or design project. Such development efforts may be complex and time-consuming, and any skilled artisan shall not require excessive experimentation and shall perform routine work in design, manufacturing, and production.

It should be noted that the above embodiments are provided to illustrate technical solutions of the present disclosure and not limit the present disclosure. Although the present disclosure is described in detail by referring to embodiments, any ordinary skilled person in the art shall understand that modifications or equivalent replacements may be made to the technical solutions of the present disclosure without departing from the spirit and the scope of the present disclosure. All modifications or replacements shall be covered by the scope of the claims of the present disclosure.

What is claimed is:

1. An integrated golf ball tray, comprising:

a mat;

a surface layer, disposed and stacked at a top of the mat and fixedly connected thereto, wherein the surface layer is configured for a player to stand thereon and to withstand repeated strikes by a golf club;

a ball tray assembly, disposed at one end of the mat;

a plurality of insertion holes, defined in a top surface of the surface layer at an end near the ball tray assembly;

wherein the ball tray assembly comprises a placement plate and a shielding strip, the placement plate being disposed at the one end of the mat, the shielding strip being fixedly connected to edges surrounding a top of the placement plate except an edge of the placement plate connected to the mat, leaving an open side configured to allow a golf club to enter the placement plate to retrieve a golf ball back to the surface layer;

wherein the placement plate has a smooth upper surface to reduce resistance against ball rolling;

wherein a top surface of the placement plate is located at an equal height as a top surface of the mat;

wherein the plurality of insertion holes are each configured to receive a marker rod for assisted training; and wherein a drainage gap is defined from each of two ends of the shielding strip to the surface layer to allow water to drain out from the ball tray assembly.

2. The integrated golf ball tray according to claim 1, wherein, a snap slot is defined in a side of the placement plate, and a snap bar is fixedly connected to an end of the mat.

3. The integrated golf ball tray according to claim 2, wherein, the snap slot and the snap bar are mated to each other.

4. The integrated golf ball tray according to claim 2, wherein the snap slot is U-shaped.

5. The integrated golf ball tray according to claim 2, wherein a surface of the snap bar is arranged with protruding patterns to be mated with recesses in an inner wall of the snap slot.

6. The integrated golf ball tray according to claim 2, wherein the snap bar has elasticity such that, after being inserted into the snap slot, the snap bar slightly expands to form a tight connection.

7. The integrated golf ball tray according to claim 2, wherein the snap slot and the snap bar are configured to allow the ball tray assembly to be quickly disassembled from the mat for cleaning or replacement.

8. The integrated golf ball tray according to claim 2, wherein the snap slot and the snap bar are configured to allow the ball tray assembly to be interchangeable with ball tray assemblies of different specifications for different training phases.

9. The integrated golf ball tray according to claim 2, wherein the snap slot is an elongated groove defined in a side of the placement plate facing toward the mat; wherein a cross-section of the snap slot taken perpendicular to a longitudinal axis thereof is substantially U-shaped, the U-shape having a substantially rectangular bottom portion; and wherein two top ends of two vertical sides of the U-shape respectively extend toward each other in a direction parallel to a bottom side of the U-shape to form flanges that prevent the snap bar from disengaging from the snap slot, such that a length of the bottom side of the U-shape is longer than a length of a drainage gap at a top of the U-shape.

10. The integrated golf ball tray according to claim 1, wherein the surface layer is made of artificial turf comprising polypropylene and polyethylene, having a density of 71600 tuft stitches per square meter, and having a height of 16 mm.

11. The integrated golf ball tray according to claim 10, wherein the polypropylene accounts for 85% by weight and the polyethylene accounts for 15% by weight.

12. The integrated golf ball tray according to claim 10, wherein the artificial turf is formed by a high-temperature crimping process to form crimped upright grass tufts.

13. The integrated golf ball tray according to claim 1, wherein the placement plate and the mat are made of ethylene-vinyl acetate having a Shore hardness of 25 degrees.

14. The integrated golf ball tray according to claim 1, wherein the shielding strip and the placement plate are integrally molded as a one-piece structure.

15. The integrated golf ball tray according to claim 1, wherein the placement plate is configured to have at least three rows of golf balls placed on a top thereof.

16. The integrated golf ball tray according to claim 15, wherein the placement plate provides an additional space beyond the at least three rows of golf balls, the additional space being configured to allow a golf club to enter and retrieve a golf ball.

17. The integrated golf ball tray according to claim 1, wherein the drainage gap has a width of 10 mm.

18. The integrated golf ball tray according to claim 1, wherein a height of the surface layer is greater than a height of the shielding strip.

19. The integrated golf ball tray according to claim 1, wherein the marker rod is insertable into any of the plurality of insertion holes to assist a player in swing path training.

20. The integrated golf ball tray according to claim 1, wherein the shielding strip extends upwardly from the top surface of the placement plate to form a barrier preventing golf balls from rolling off the placement plate.

* * * * *